US006324853B1

(12) United States Patent
Kelly et al.

(10) Patent No.: US 6,324,853 B1
(45) Date of Patent: Dec. 4, 2001

(54) DE-ICING FOR LOW TEMPERATURE REFRIGERATION DEVICES

(75) Inventors: Allan D. Kelly; Paul Steinhoff, both of Asheville, NC (US)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/672,256

(22) Filed: Sep. 28, 2000

(51) Int. Cl.[7] ..... F25D 21/00

(52) U.S. Cl. ..... 62/80; 62/151; 62/155; 62/275; 62/440

(58) Field of Search ..... 62/275, 148, 155, 62/349, 351, 444, 452, 80, 298, 151, 440

(56) References Cited

U.S. PATENT DOCUMENTS

| | | | | |
|---|---|---|---|---|
| 2,420,240 | * | 5/1947 | Haggerty | 62/89 |
| 2,858,408 | * | 10/1958 | Barroero | 62/19 |
| 4,009,586 | * | 3/1977 | Skvarenina | 62/277 |
| 4,305,259 | * | 12/1981 | Jaescke | 62/140 |
| 4,531,376 | * | 7/1985 | Alsenz | 62/156 |
| 4,827,729 | * | 5/1989 | Groth et al. | 62/80 |
| 5,339,643 | * | 8/1994 | Pikaart | 62/80 |
| 5,682,756 | * | 11/1997 | Lehmiller et al. | 62/157 |
| 5,899,078 | * | 5/1999 | Mager | 62/80 |

FOREIGN PATENT DOCUMENTS

0911591 A1 4/1999 (EP) .

* cited by examiner

*Primary Examiner*—Henry Bennett
*Assistant Examiner*—Melvin Jones
(74) *Attorney, Agent, or Firm*—Pepper Hamilton, LLP

(57) ABSTRACT

A de-icing system operable to facilitate the removal of ice from the door (18) and closure surface (22) of a low temperature refrigeration or ultra-low freezer device (10) and to thereby ensure proper operation of the device (10) and protect its contents. The de-icing system employs manually activated heaters (32) and a timing circuit (38) to thaw the ice. Because the de-icing system focuses heat only on specific, ice-sensitive areas, the temperature of the freezer's interior compartment (14) remains constant so that the contents need not be removed during the de-icing process. In use, an operator activates the de-icing system a few minutes prior to opening the freezer door (18). When the door (18) is opened, the melted or loosened ice can be removed with a soft cloth. If the operator forgets that the heaters have been activated, the timing circuit (38) automatically terminates the de-icing process and stops the heaters (32) before the freezer's interior storage temperature has been affected. Optional thermal fuses (42) provides a safety cut-off should the timing circuit (38) fail or the heaters (32) exceed a pre-established temperature.

8 Claims, 1 Drawing Sheet

DE-ICING FOR LOW TEMPERATURE REFRIGERATION DEVICES

BACKGROUND OF THE INVENTION

1. Field of the Invention

The present invention relates to devices for preventing the accumulation of ice in low temperature refrigeration devices. More particularly, the invention relates to heating devices for facilitating the removal of accumulated ice from the doors and corresponding closure surfaces of low temperature refrigeration devices, including ultra-low temperature freezers.

2. Description of the Prior Art

Low temperature refrigeration devices, especially ultra-low freezers, are commonly used in laboratory settings for storing biological samples. These freezers typically operate between approximately −40° C. and −95° C., and can develop substantial ice build-up around the door seal and closure surfaces depending on frequency of entry, ambient temperature, and humidity conditions. The accumulated ice can have seriously debilitating affects on freezer performance, including interfering with proper door sealing and interior accessibility, and overloading the door latching and mounting mechanisms. Even moderate amounts of ice build-up can so interfere with proper sealing that the required interior temperature cannot be maintained or can only be maintained by overworking the cooling mechanism. When this happens, valuable, perhaps irreplaceable, freezer's contents may be damaged by thawing.

A well-known method of de-icing involves allowing the built-up ice to thaw naturally. This inconveniently entails removing the entire contents of the iced freezer to a second freezer, and waiting for the ice to thaw. Any attempt to artificially hasten thawing, including prying the ice loose, pouring hot water on the ice, or placing space heaters nearby, can damage the door seals or other components of the freezer unit.

SUMMARY OF THE INVENTION

The de-icing system of the present invention presents novel enabling technology operable to facilitate the removal of ice from the door seals and closure surfaces of a low temperature refrigeration or ultra-low freezer device and thereby ensuring proper performance and preventing damage to the device and its contents. The de-icing system employs built-in manually activated heaters and a timing circuit to efficiently and conveniently thaw the accumulated ice. Because the de-icing system focuses heat only on specific, ice-sensitive areas of the freezer, the interior temperature remains relatively constant so that the freezer's contents need not be removed during the de-icing process. The reliable, mechanical timing circuit automatically terminates the process after a predetermined period of time. Optional thermal fuses provide a safety cut-off in the event the heaters exceed a pre-established maximum temperature.

In use, an operator activates the de-icing system a few minutes prior to opening the freezer's door. When the door is opened, the melted or loosened ice can be removed from the door and closure surfaces with a soft cloth. Either the timing circuit or the the thermal fuses will automatically terminate the de-icing process before the freezer's interior storage temperature is detrimentally affected.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
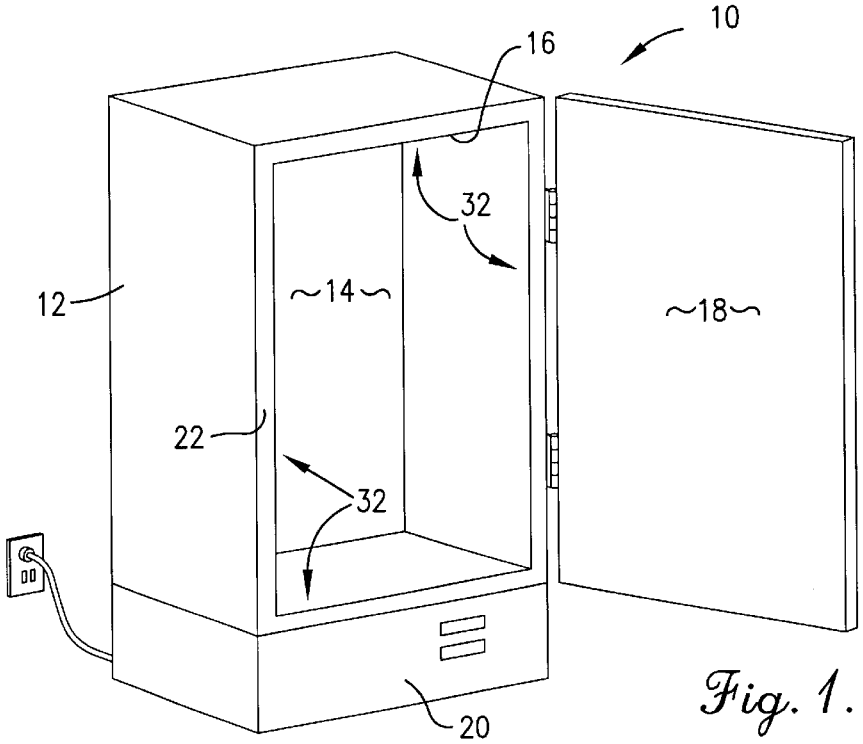
FIG. 1 is a perspective view of an ultra-low freezer unit showing the placement of the heating elements of a preferred embodiment of the present invention.

Referring to FIG. 1, an ultra-low freezer unit 10 is shown which incorporates the de-icing system of the present invention to prevent ice accumulation on the door seal and closure surfaces of the freezer 10. The freezer 10, which is itself entirely conventional, broadly comprises an insulated housing 12; an interior storage compartment 14; an opening 16; a door 18; and a cooling mechanism 20. The de-icing system of the present invention may be used with any conventional freezer such as those manufactured and sold by Revco, Harris, Ontario Ovens Inc., and Sanyo.

The housing 12 is preferably insulated and of a material and design suitable for both maintaining the interior temperature of the freezer 10 and protecting the contents from damage. The housing 12 encloses the interior compartment 14 wherein the freezer's contents are stored at low temperatures. Although the interior compartment 14 is shown as a single large cavity, the interior space may be divided into a plurality of interior compartments.

An opening 16 in both the housing 12 and the interior compartment 14 provides access to the low temperature interior environment and the contents located therein. A door 18 is hingedly mounted to the housing 10 and positionable to cover the opening 16 when closed. The door 18 is preferably insulated to the same degree as the housing 12, and preferably includes a gasket or seal which corresponds to the closure surface 22 surrounding the opening 14 and operable to ensure a tight seal and little, if any, air transfer when the door 18 is closed. Alternatively or additionally, the closure surface 22 may include a gasket or seal for the same purpose.

The cooling mechanism is operable to transfer ambient heat from the interior compartment 14 to the environment exterior of the insulated housing 12. Various suitable cooling mechanisms are well-known and readily available, and the present invention is independent of any particular cooling mechanism.

For various reasons, ice is likely to accumulate on the closure surface 22 and corresponding portions of the door 18. The rate of ice build-up depends on such factors as frequency of entry, ambient temperature, and humidity conditions. This ice may interfere with proper mating and sealing of the door 18 and closure surface 22, thereby allowing air transfer and creating conditions under which maintaining the desired temperature of the interior compartment 14 is difficult or impossible.

Figure 2:
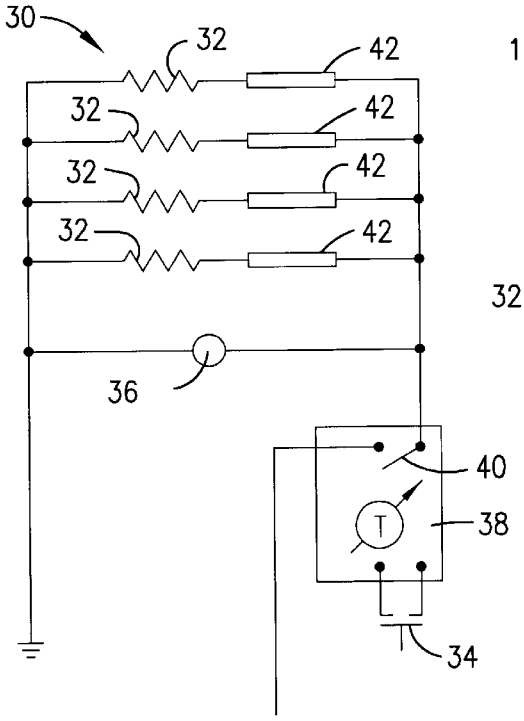
FIG. 2 is a schematic of the heating and timing circuit of a preferred embodiment of the present invention.

The de-icing system of the present invention is operable to periodically thaw the ice, thereby facilitating its removal and ensuring proper operation of the device 10. The de-icing system is shown in FIG. 2 as an electrical circuit 30 comprising at least one heating element 32; an activation switch 34; an indicator light 36; and a timing circuit 38.

Figure 3:
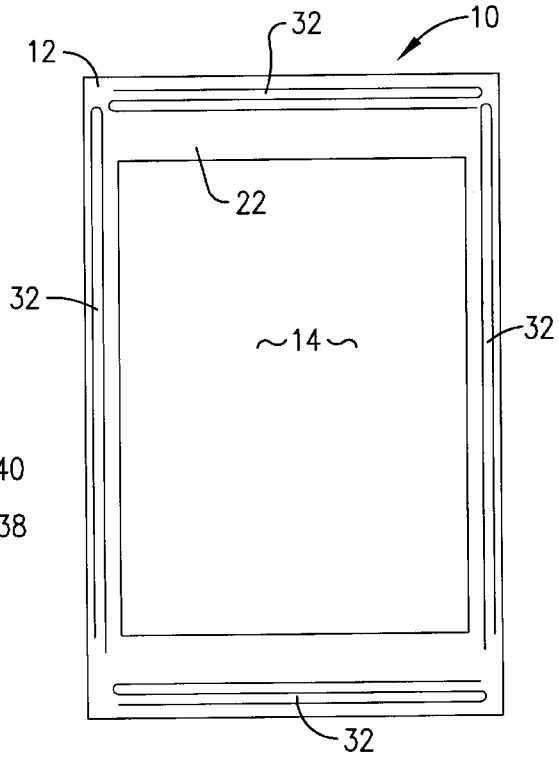
FIG. 3 is a sectional view of an ultra-low freezer further illustrating placement of the heating elements.

The heating elements 32 are operable to warm the closure surface in order to melt or loosen accumulated ice and thereby facilitate the ice's removal. A plurality of strategically placed heating elements 32 are preferred, though a single element could be used. The preferred positioning of the heating elements with regard to the refrigeration device as a whole is illustrated in FIGS. 1 and 3. The heaters 32 are preferably built into or mounted behind the closure surface 22. Thermally conductive foils (not shown) may be used to concentrate heat on the closure surface 22 and corresponding door portions.

The activation switch 34 is operable to initiate the de-icing process by energizing the heating elements 32 and starting the timing circuit 38. The indicator light 36 visually communicates that the de-icing process is in progress. The light 36 activates when the switch 34 is closed and remains lit while the heating elements 32 are producing heat. The de-icing process terminates and the heaters 32 de-energized when a pre-established time or temperature condition is satisfied.

The timing circuit 40 is operable to close an internal switch 40 when the activation switch 34 is activated, thereby allowing the heaters 32 to produce heat. The circuit 38 is further operable to measure a predetermined period of time, preferably fifteen minutes, following activation, and to terminate the de-icing process at the expiration of that time by opening the internal switch 40 to cause the heaters 32 to de-energize. Thus, the timing circuit 38 is included as a safety feature to prevent continuous heat input. Absent the timing circuit 38, the heaters 32 might run indefinitely, possibly damaging nearby gaskets or seals, or undesirably raising the temperature of the interior compartment 14. The timing circuit 38 is preferably mechanical in nature rather than electronic.

Thermal switches 42 operable to power-down the heaters 32 after reaching a predetermined temperature may be included as an alternative or in addition to the timing circuit 38. The thermal switches 42 are preferably resettable fuses.

To use the de-icing system, an operator depresses the activation switch 34, thereby energizing the heating elements 32 and starting the timing circuit 38. The indicator light 36 activates to indicate that the de-icing process has begun. After a few minutes, the operator opens the door 18 to the refrigeration device 10 and removes with a soft cloth any water or loose ice resulting from de-icing. The timing circuit 38 causes the heaters 32 to de-energize and the light 36 to extinguish fifteen minutes after the switch 34 was activated. If the heaters 32 reach a predetermined temperature at any time, the optional thermal switches 42 terminate the de-icing process without regard to the timing circuit 38.

From the preceding description, it can be seen that the de-icing system of the present invention efficiently and conveniently facilitates the removal of accumulated ice from freezer doors and closure surfaces. It is noted that the present invention is a de-icing system independent of any particular freezer or refrigeration device.

Applications are contemplated for the de-icing system herein described that require only minor modifications to the system as disclosed. Thus, although the invention has been described with reference to the preferred embodiment illustrated in the attached drawings, it is noted that equivalents may be employed and substitutions made herein without departing from the scope of the invention as recited in the claims.

For example, the circuit 30 may be integrally incorporated into new freezers during manufacture, or may be produced in stand-alone form for use with existing refrigeration devices. Furthermore, the heating elements 32, timing circuit 38, and other components may be any suitable off-the-shelf or custom equipment, as practical and desirable.

Having thus described the preferred embodiment of the invention, what is claimed as new and desired to be protected by Letters Patent includes the following:

1. A de-icing system for use with a refrigeration device having a door and corresponding closure surface susceptible to the accumulation of ice, the de-icing system being operable to facilitate the removal of the ice from the door and closure surface, the de-icing system comprising:

at least one heater positioned near the closure surface and operable to apply heat to the door and closure surface in order to facilitate the removal of accumulated ice;

an activation switch operable to cause the heater to produce heat; and a timing circuit operable to automatically cause the heater to stop producing heat after a predetermined period of time.

2. The de-icing system of claim 1, further comprising at least one thermally conductive foil operable to concentrate the heat produced by the heater.

3. The de-icing system of claim 1, further comprising at least one thermal switch associated with each heater and operable to cause the heater to stop producing heat when the heat reaches a predetermined temperature.

4. The de-icing system of claim 3, the thermal switch being a resettable thermal fuse.

5. A refrigeration device comprising:

a housing enclosing at least one storage compartment, with the housing having at least one opening for providing access to the storage compartment;

at least one door positionable and operable to cover and seal the opening along a closure surface, the door and closure surface being susceptible to ice accumulation; and a de-icing system comprising at least one heater positioned near the closure surface and operable to apply heat to the door and closure surface in order to facilitate the removal of accumulated ice;

an activation switch operable to cause the heater to produce heat; and a timing circuit operable to automatically cause the heater to stop producing heat after a predetermined period of time.

6. The refrigeration device of claim 5, further comprising at least one thermally conductive foil operable to concentrate the heat produced by the heater.

7. The refrigeration device of claim 5, further comprising at least one thermal switch associated with each heater and operable to cause the heater to stop producing heat when the heat reaches a predetermined temperature.

8. The refrigeration device of claim 7, the thermal switch being a resettable thermal fuse.

* * * * *